US007581525B2

(12) United States Patent
Hanold et al.

(10) Patent No.: US 7,581,525 B2
(45) Date of Patent: Sep. 1, 2009

(54) TWIN CYLINDER MOTORCYCLE ENGINE

(75) Inventors: Brian Hanold, Richland Center, WI (US); Floyd Baker, Readstown, WI (US); Bruce Tessmer, Richland Center, WI (US); Scott Sjovall, Westby, WI (US)

(73) Assignee: S & S Cycle, Inc., Viola, WI (US)

( * ) Notice: Subject to any disclaimer, the term of this patent is extended or adjusted under 35 U.S.C. 154(b) by 0 days.

(21) Appl. No.: 11/882,382

(22) Filed: Aug. 1, 2007

(65) Prior Publication Data

US 2007/0266987 A1 Nov. 22, 2007

Related U.S. Application Data

(62) Division of application No. 10/845,126, filed on May 14, 2004, now abandoned.

(51) Int. Cl.
*F01M 3/04* (2006.01)

(52) U.S. Cl. ..... 123/196 M; 123/90.33; 123/90.34; 123/90.36

(58) Field of Classification Search ..... 123/196 R, 123/196 M, 90.33, 90.34, 90.36, 90.38, 90.39, 123/90.4, 195 C
See application file for complete search history.

(56) References Cited

U.S. PATENT DOCUMENTS

| | | | |
|---|---|---|---|
| 1,392,597 | A | 10/1921 | Ricardo |
| 1,472,068 | A | 10/1923 | Harley |
| 1,770,730 | A | 7/1930 | Henry |
| 2,067,114 | A | 1/1937 | Ashton |
| 2,314,059 | A | 3/1943 | Steiner |
| 2,373,360 | A | 4/1945 | Walsh |
| 2,713,852 | A | 7/1955 | Trout |
| 2,874,804 | A | 2/1959 | Haas |
| 2,883,001 | A | 4/1959 | Dierksen |
| 3,038,459 | A | 6/1962 | Schmid |
| 3,048,156 | A | 8/1962 | Slooten |
| 3,195,527 | A | 7/1965 | Eaton |
| 3,428,296 | A | 2/1969 | Erickson |

(Continued)

FOREIGN PATENT DOCUMENTS

CN 1180802 A 5/1998

(Continued)

OTHER PUBLICATIONS

RevTech. TM. Cylinder Heads, Custom Chrome Catalog, p. 312 (1994).

(Continued)

*Primary Examiner*—Hai H Huynh
(74) *Attorney, Agent, or Firm*—Price, Heneveld, Cooper, DeWitt & Litton LLP

(57) ABSTRACT

A rocker box, pushrod assembly, oil delivery system, tappets and tappet guides are provided for an engine, particularly a shovelhead motorcycle engine. The rocker box includes a separable upper portion and lower portion with a seal for sealing the upper portion and lower portion when coupled together. The pushrod assembly includes an adjusting unit that collapses into a pushrod shaft. The oil delivery system includes an oil passageway(s) in a rocker shaft of a rocker arm assembly, and at least one of an oil passageway(s) in a rocker box and an oil passageway(s) in a pushrod assembly.

20 Claims, 19 Drawing Sheets

U.S. PATENT DOCUMENTS 3,590,953 A 7/1971 Wellauer
3,601,515 A 8/1971 Pelizzoni
3,612,016 A 10/1971 Jelen
3,719,377 A 3/1973 Schultz et al.
3,830,209 A 8/1974 Jones, Jr. et al.
3,958,570 A 5/1976 Vogelman et al.
4,126,318 A 11/1978 Belter
4,135,478 A 1/1979 Rassey
4,296,716 A 10/1981 Hofbauer
4,364,340 A 12/1982 Kimura
D277,756 S 2/1985 Davidson
4,505,236 A * 3/1985 Nakamura ..... 123/90.27
4,509,473 A 4/1985 Hamparian
RE31,877 E 5/1985 Nomura
4,515,346 A 5/1985 Gaterman, III
D279,294 S 6/1985 Davidson
D280,200 S 8/1985 Iwakura et al.
4,574,914 A 3/1986 Flugger
D283,995 S 5/1986 Kohama et al.
4,589,384 A 5/1986 Ott
4,592,311 A 6/1986 Makino
4,602,607 A 7/1986 Balsley
4,653,726 A 3/1987 Lang et al.
4,681,189 A 7/1987 Krisiloff
4,721,090 A 1/1988 Kato
D294,264 S 2/1988 Davidson et al.
4,762,201 A 8/1988 Malik
4,783,087 A 11/1988 DeCore et al.
4,825,818 A 5/1989 Hamamura
4,862,839 A 9/1989 Bridges
4,989,556 A 2/1991 Shiina et al.
5,058,542 A 10/1991 Grayson et al.
5,072,697 A 12/1991 Sputhe
5,095,862 A 3/1992 Murphy
5,105,777 A 4/1992 Kronich et al.
5,143,351 A 9/1992 Pierce
5,176,116 A * 1/1993 Imagawa et al. ..... 123/196 W
5,183,130 A 2/1993 Nakamura et al.
5,205,244 A 4/1993 Nakamura et al.
5,233,967 A 8/1993 Peller
5,251,583 A 10/1993 Shinohara
5,255,640 A 10/1993 Pierce
5,301,767 A 4/1994 Shiohara
5,310,198 A 5/1994 Belter
5,317,999 A 6/1994 Kern
5,322,039 A 6/1994 Kinsey
5,323,740 A 6/1994 Daily et al.
5,394,843 A * 3/1995 Decuir ..... 123/90.39
5,421,292 A 6/1995 Hoffman et al.
5,492,085 A 2/1996 Tiller et al.
5,497,735 A 3/1996 Kern
RE35,282 E 6/1996 Blane
5,553,583 A 9/1996 Jones
5,560,446 A 10/1996 Onishi
5,577,570 A 11/1996 Shiohara et al.
5,603,515 A 2/1997 Bock
5,605,342 A 2/1997 Genin et al.
5,647,337 A 7/1997 Johnson
5,662,075 A 9/1997 Lyndhurst
5,673,661 A 10/1997 Jesel
5,908,079 A 6/1999 Amino
5,921,210 A 7/1999 Regueiro
5,924,937 A 7/1999 Kuo
5,937,816 A 8/1999 Wincewicz
5,979,583 A 11/1999 Amino et al.
5,983,849 A 11/1999 Wangen et al.
6,047,667 A 4/2000 Leppanen et al.
6,085,855 A 7/2000 Schanz et al.
6,116,205 A 9/2000 Troxler
D432,546 S 10/2000 Savage et al.
6,138,625 A * 10/2000 Garrison ..... 123/90.39
D434,047 S 11/2000 Ballentine
D436,112 S 1/2001 Savage et al.
6,173,689 B1 1/2001 Tanaka
6,176,211 B1 1/2001 Tanaka
D437,572 S 2/2001 Rodriguez
6,209,502 B1 4/2001 Davis et al.
6,237,554 B1 * 5/2001 Garrison ..... 123/90.39
6,241,040 B1 6/2001 Schanz et al.
6,263,847 B1 7/2001 Hoffman
6,267,193 B1 7/2001 Buell
D449,620 S 10/2001 Feuling
6,296,071 B1 * 10/2001 Runte et al. ..... 180/219
6,345,613 B1 2/2002 Hubbard et al.
6,374,815 B1 4/2002 Ness et al.
D463,451 S 9/2002 Wangen
D463,801 S 10/2002 Kinsey et al.
D463,802 S 10/2002 Kinsey et al.
D466,133 S 11/2002 Kinsey et al.
D467,940 S 12/2002 Kinsey et al.
6,510,823 B2 1/2003 Hirano et al.
6,539,911 B2 * 4/2003 Durr et al. ..... 123/196 R
6,666,184 B2 * 12/2003 Kurihara et al. ..... 123/196 R
6,691,661 B2 2/2004 Lundgreen et al.
6,830,030 B2 * 12/2004 Imafuku et al. ..... 123/318
6,854,436 B1 2/2005 English
6,883,483 B1 4/2005 Knudsen
6,883,505 B1 * 4/2005 Francis ..... 123/572
D521,025 S 5/2006 Egland et al.
D522,022 S 5/2006 Carlin et al.
7,059,210 B2 6/2006 Thiessen et al.
7,063,078 B2 6/2006 Dees et al.
7,178,498 B2 * 2/2007 Takeuchi ..... 123/196 R
7,246,610 B2 * 7/2007 Sjovall et al. ..... 123/572
2005/0193965 A1 * 9/2005 Nakatsuka et al. ..... 123/41.44
2006/0254556 A1 * 11/2006 Hu ..... 123/196 M
2007/0125333 A1 * 6/2007 Chriswell et al. ..... 123/90.39

FOREIGN PATENT DOCUMENTS

GB 194509 3/1923
GB 386947 4/1931
GB 621557 4/1949
JP 63-129107 6/1988
JP 63-235606 9/1988
JP 63-259111 10/1988
JP 7-77021 3/1995
JP 8-218817 8/1996
JP 9-317409 12/1997
JP 10-238404 9/1998
WO 99/66229 A3 12/1999

OTHER PUBLICATIONS

RevTech. TM. Cylinder Heads for Evolution. RTM. Motors Without Component Parts, Custom Chrome Catalog, p. 314 (1994).

* cited by examiner

Figure 8C
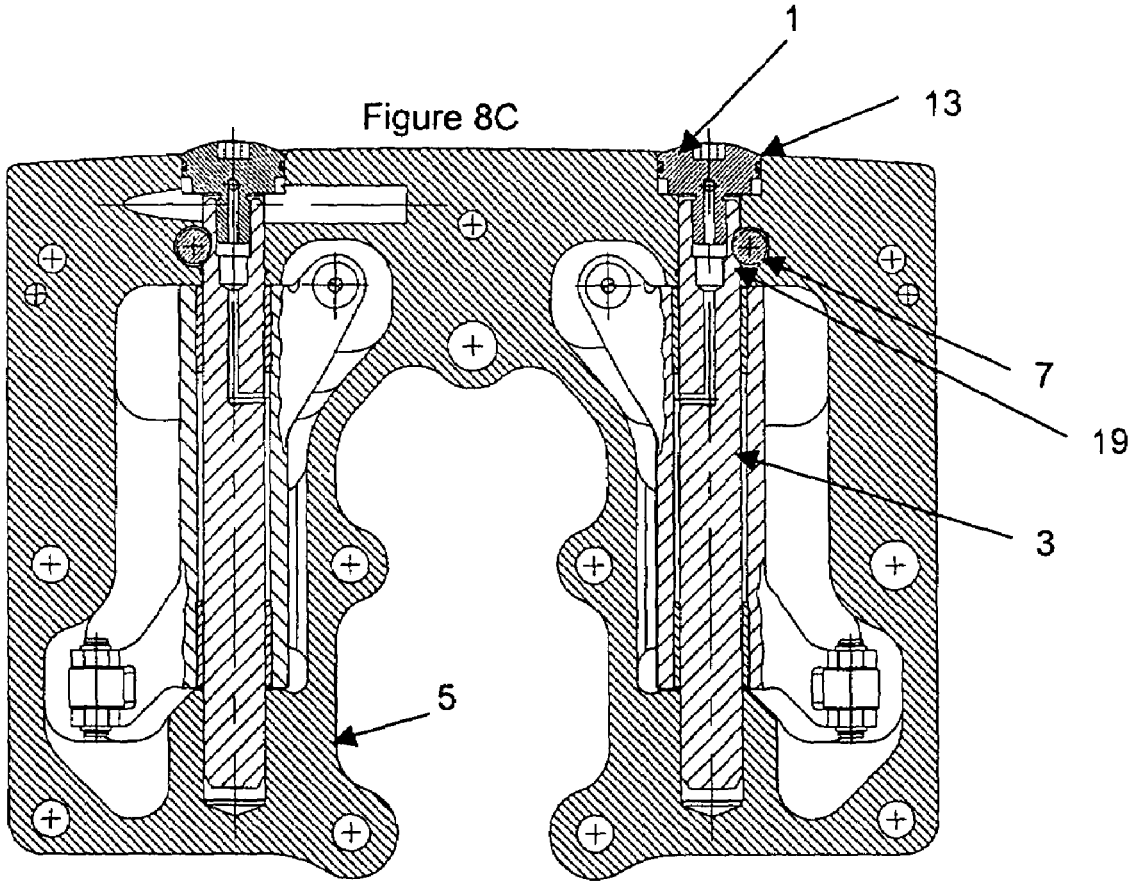
SECTION B-B
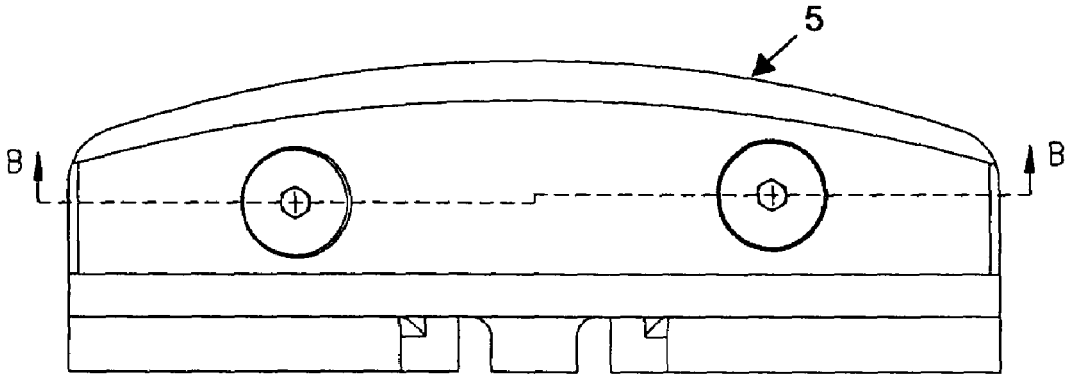
Figure 8D

Figure 15
Figure 15A
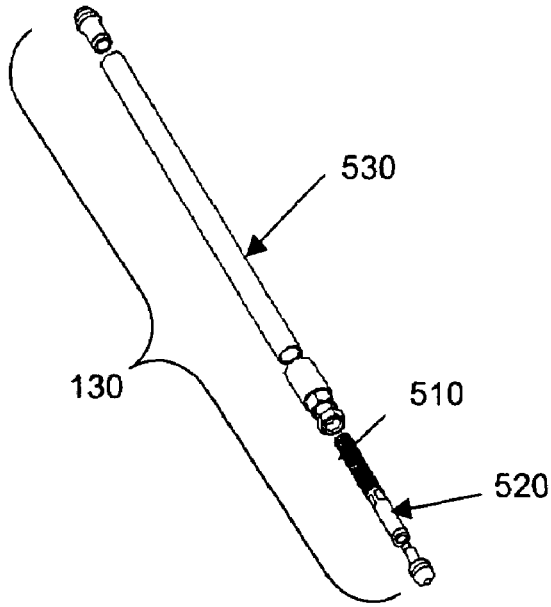
Figure 15B
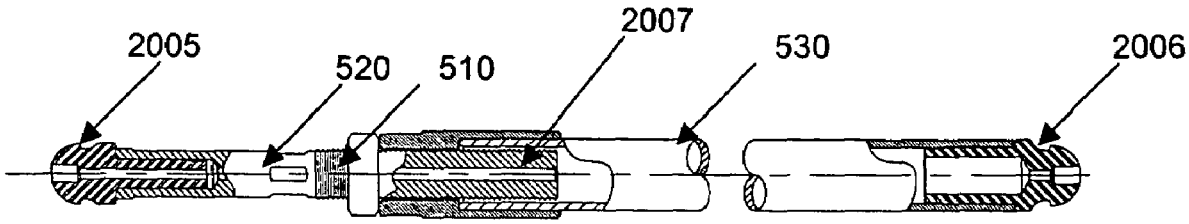

SECTION A-A

SECTION B-B

Figure 17
Figure 17A
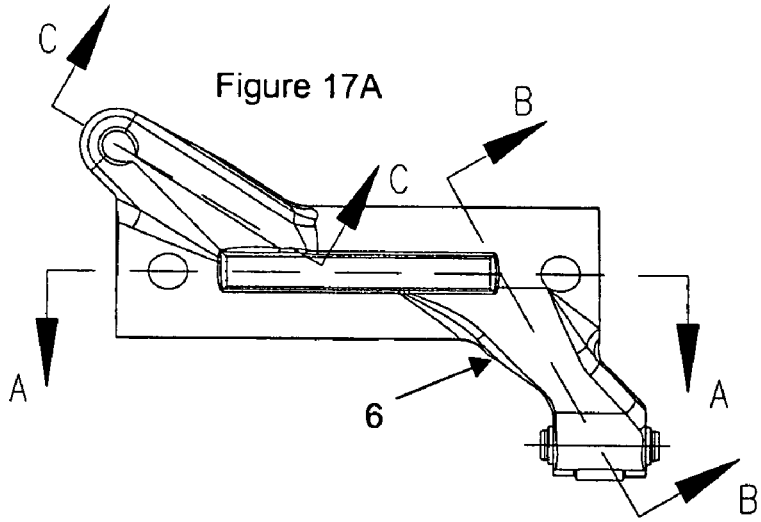
Figure 17B
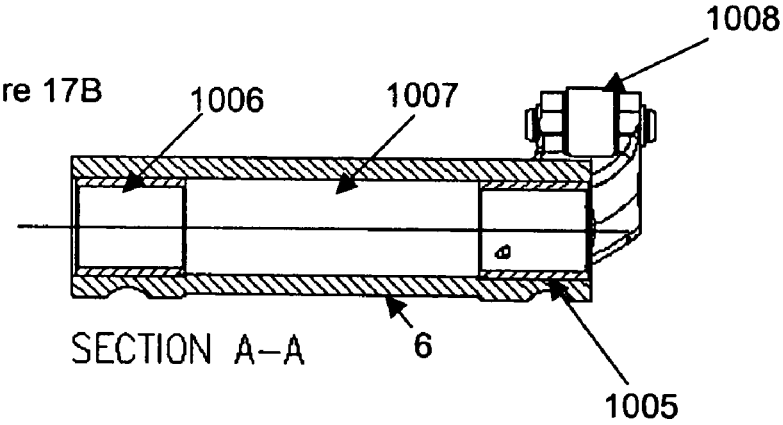
Figure 17C
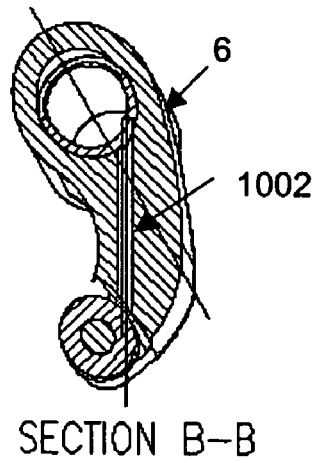

SECTION C–C

TWIN CYLINDER MOTORCYCLE ENGINE

BACKGROUND OF THE INVENTION

This application is a divisional of application Ser. No. 10/845,126 filed May 14, 2004, the entire disclosure of which is incorporated by reference herein.

FIELD OF THE INVENTION

The present invention relates generally to rocker boxes, pushrods, tappets, tappet guides, and oil delivery systems for combustion engines, and more particularly to such devices as applied to twin cylinder motorcycle engines.

DESCRIPTION OF THE RELATED ART

Conventional rocker boxes typically involve a cast structure with parts (e.g., rocker arms, pushrods, etc.) extending into and/or mounted within the cast structure. Due, in part, to the integral nature of cast rocker boxes, installing, removing, and adjusting the parts extending into and/or mounted within the cast rocker box is difficult. As such, in many instances the entire cylinder head and rocker box must be removed from the motorcycle in order to access the parts positioned therein. Even after removal of the cylinder head and rocker box, the movable parts extending into and/or mounted within the cast rocker box are still difficult to access.

Additionally, the cast structure of conventional shovelhead rocker boxes tends to have a rough outer surface, which is difficult to finish into a smooth, more aesthetically pleasing surface. Further, this surface is particularly difficult to polish and/or chrome plate due to inconsistencies and defects inherent in parts produced by known casting processes. As such, it is difficult to manufacture a rocker box with an aesthetically pleasing outer surface.

Another exemplary rocker box is described in U.S. Pat. No. 6,296,071, which is incorporated by reference herein in its entirety. The '071 patent includes a rocker box with a separable rocker support for supporting a pair of rocker arms and a breather apparatus for regulating oil blow by. This rocker support increases the part count and complexity of the rocker box assembly, and reduces the structural rigidity with which the rocker arms are supported. Further, the added space for supporting the breather apparatus needlessly increases the size of the device in motorcycle engines which do not require a breather apparatus at all.

In addition, the '071 configuration is adapted for a pushrod oiling application in which oil is supplied to the rocker arms via oil passageways along the pushrods, characteristic of evolution style motorcycle engines. Not all motorcycle engines, however, are configured to provide oiling via the pushrods. Thus, a need exists for an improved rocker box for motorcycle engines.

Other problems with the prior art not described above can also be overcome using the teachings of the present invention, as would be readily apparent to one of ordinary skill in the art after reading this disclosure.

BRIEF DESCRIPTION OF THE DRAWINGS

FIGS. 8A-8D depict portions of the rocker box of FIG. 2 at different angles (including sectional views).

FIG. 15A depicts an exploded view of an adjustable pushrod assembly according to an embodiment of the present invention.

FIG. 15B depicts a sectional view of the adjustable pushrod assembly of FIG. 15A.

FIGS. 17A-D depict views of a rocker arm assembly according to an embodiment of the present invention.

DETAILED DESCRIPTION OF THE EXEMPLARY EMBODIMENTS

Reference will now be made in detail to exemplary embodiments of the present invention. Wherever possible, the same reference numbers will be used throughout the drawings to refer to the same or like parts.

For purposes of illustration only, a twin cylinder motorcycle engine will be used to describe various features and aspects of the present invention. As an example, the present invention may be used in conjunction with Harley Davidson's Shovelhead style motorcycle engine. It should be appreciated, however, that many embodiments of the present invention are applicable to non-motorcycle engines and components (e.g., pushrods, tappet guides, etc.), to single cylinder motorcycle engines, and to motorcycle engines having more than two cylinders. As such, other uses for the present invention are contemplated in addition to those described in detail below.

Figure 1:
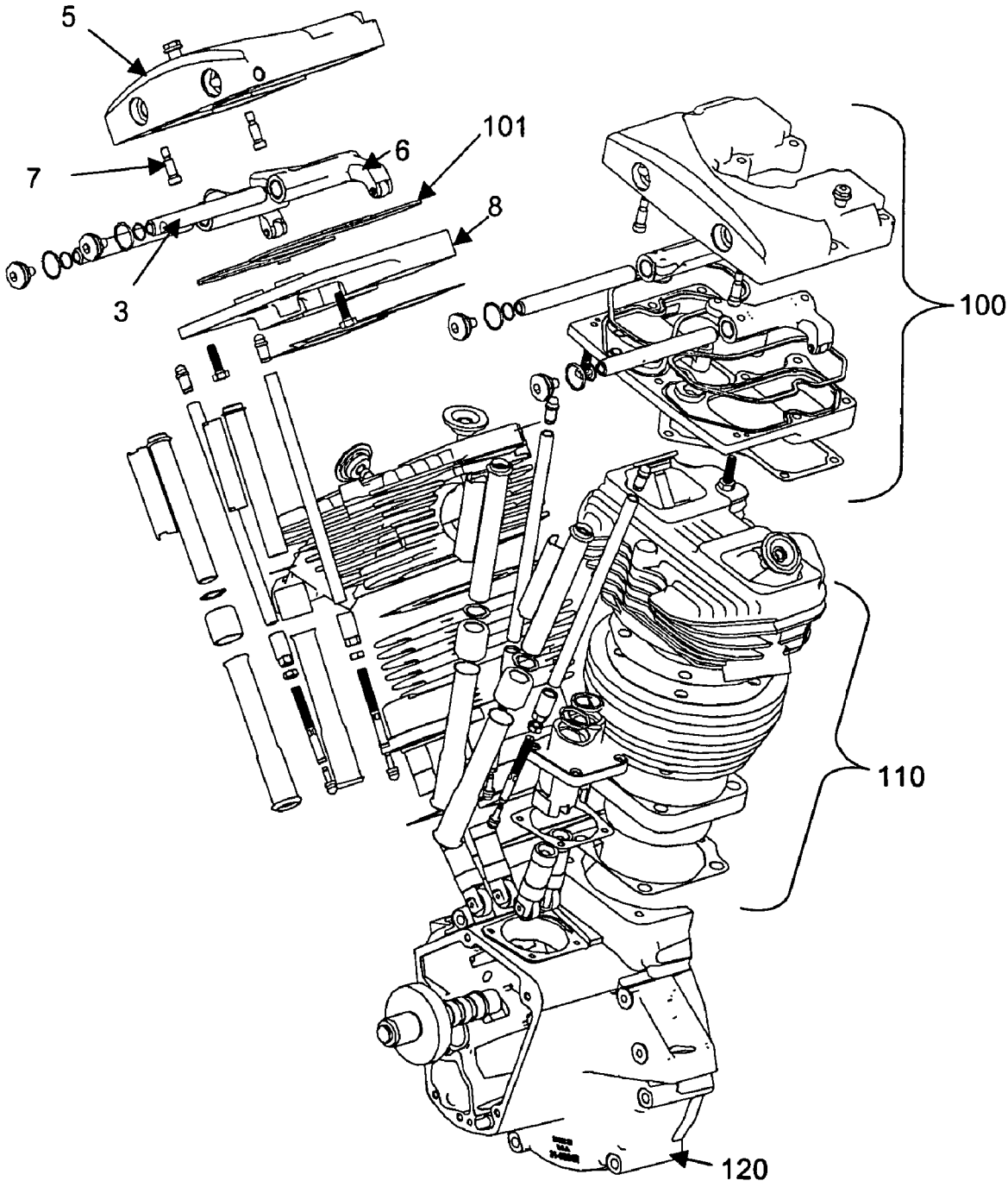
FIG. 1 depicts an exploded view of a twin cylinder shovelhead style motorcycle engine according to an embodiment of the present invention.
Figure 2:
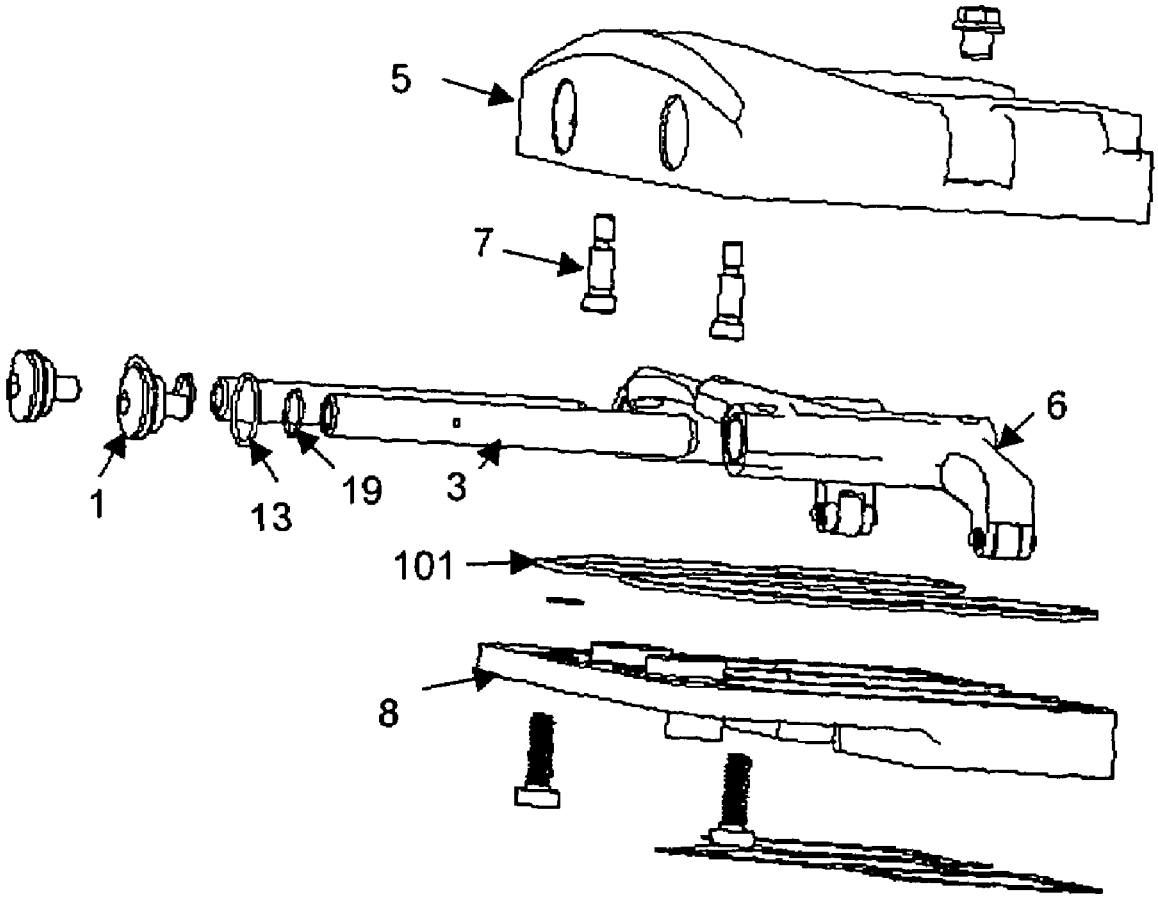
FIGS. 2-7 depict exploded views of a rocker box according to an embodiment of the present invention.

A twin cylinder motorcycle engine ("engine" hereafter) according to an embodiment of the present invention is shown in the exploded view of FIG. 1. The engine includes rocker box assemblies 100 (shown in greater detail in FIGS. 2 to 14), cylinder head assemblies 110, and a crankcase 120. Other assemblies may also be provided, as would be readily apparent to one of ordinary skill in the art after reading this disclosure.

According to one embodiment of the present invention, each of the rocker box assemblies 100 comprise a separable upper portion 5 and a lower portion 8. Preferably, the separable upper portion 5 and lower portion 8 can be coupled together so as to form an outer housing of rocker box assemblies 100, and are split substantially parallel to the mounting surface of the cylinder head. Alignment of the upper portion 5 to lower portion 8 may be facilitated by one or more dowel pins 10 (see FIG. 6), or the like. One or both of separable upper portion 5 and lower portion 8 can be made of 6160 billet aluminum or like material, and may undergo a heat treatment process (e.g., a T6 heat treatment process).

Additionally, the separable upper portion 5 and/or lower portion 8 may be finished, polished, and/or chrome plated so as to include a highly reflective and aesthetically appealing outer surface. Finishing/machining the upper portion 5 and/or lower portion 8 from billet aluminum allows precise control of dimensions, which assures consistent internal clearances between the rocker arms 6 and the upper portion 5, and between the valve springs and the upper portion 5. This is an area of concern in applications using high lift cams and/or oversized aftermarket valve springs with stock cast shovelhead style boxes, which tend to have considerable dimensional variation from part to part. Further, precise control of external dimensions assures consistent clearance between the upper portion 5 and the motorcycle frame (not shown).

Figure 3:
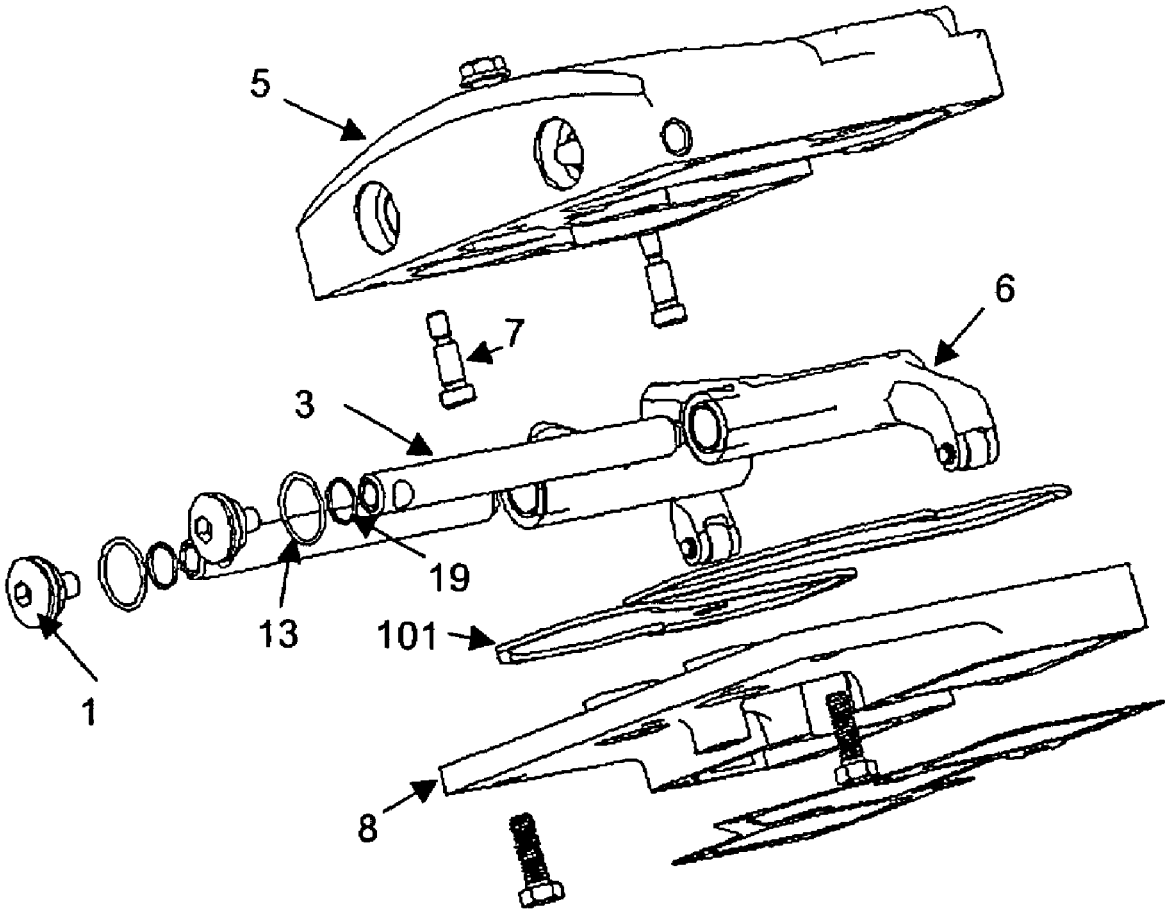
Figure 4:
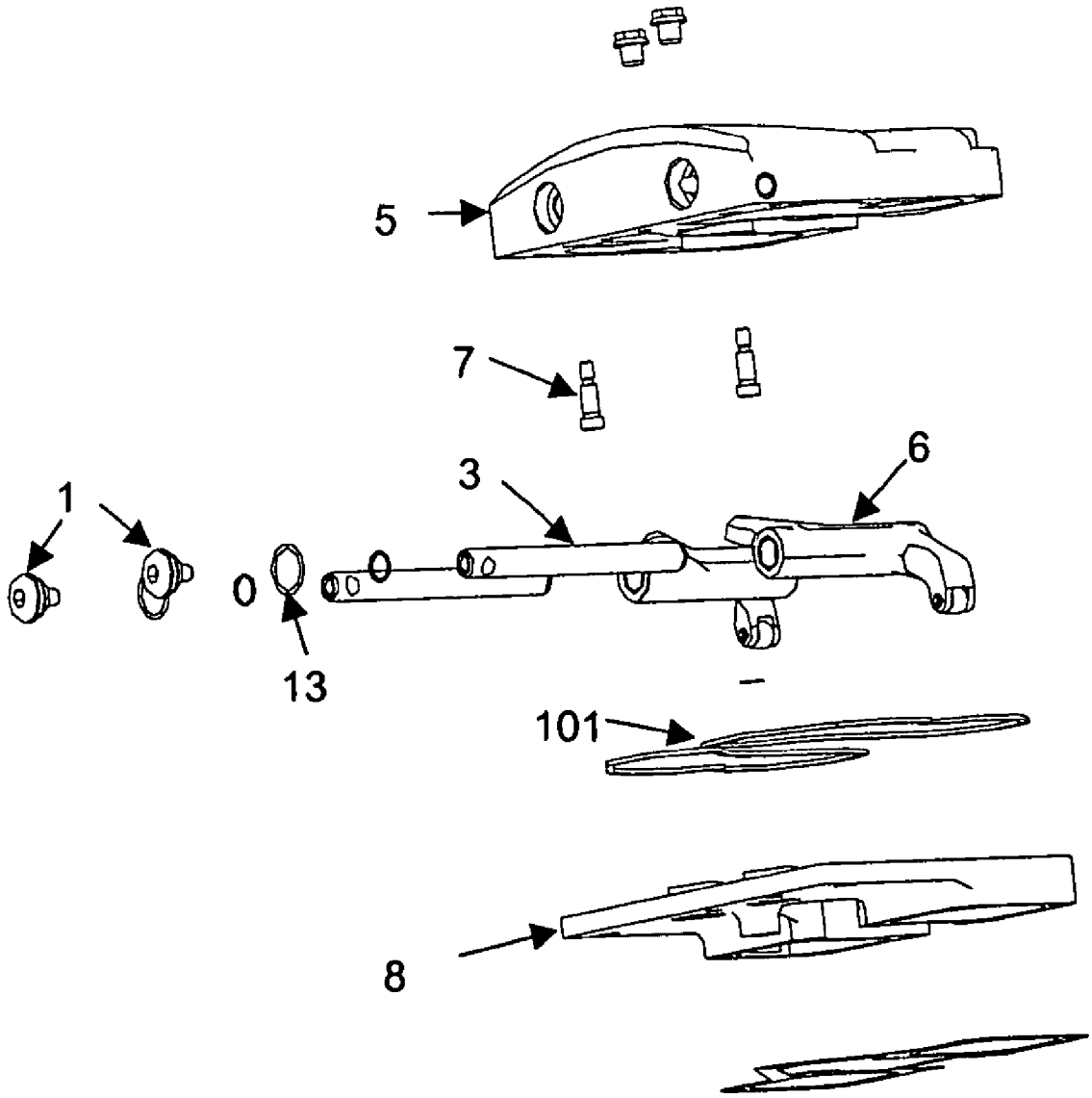
Figure 5:
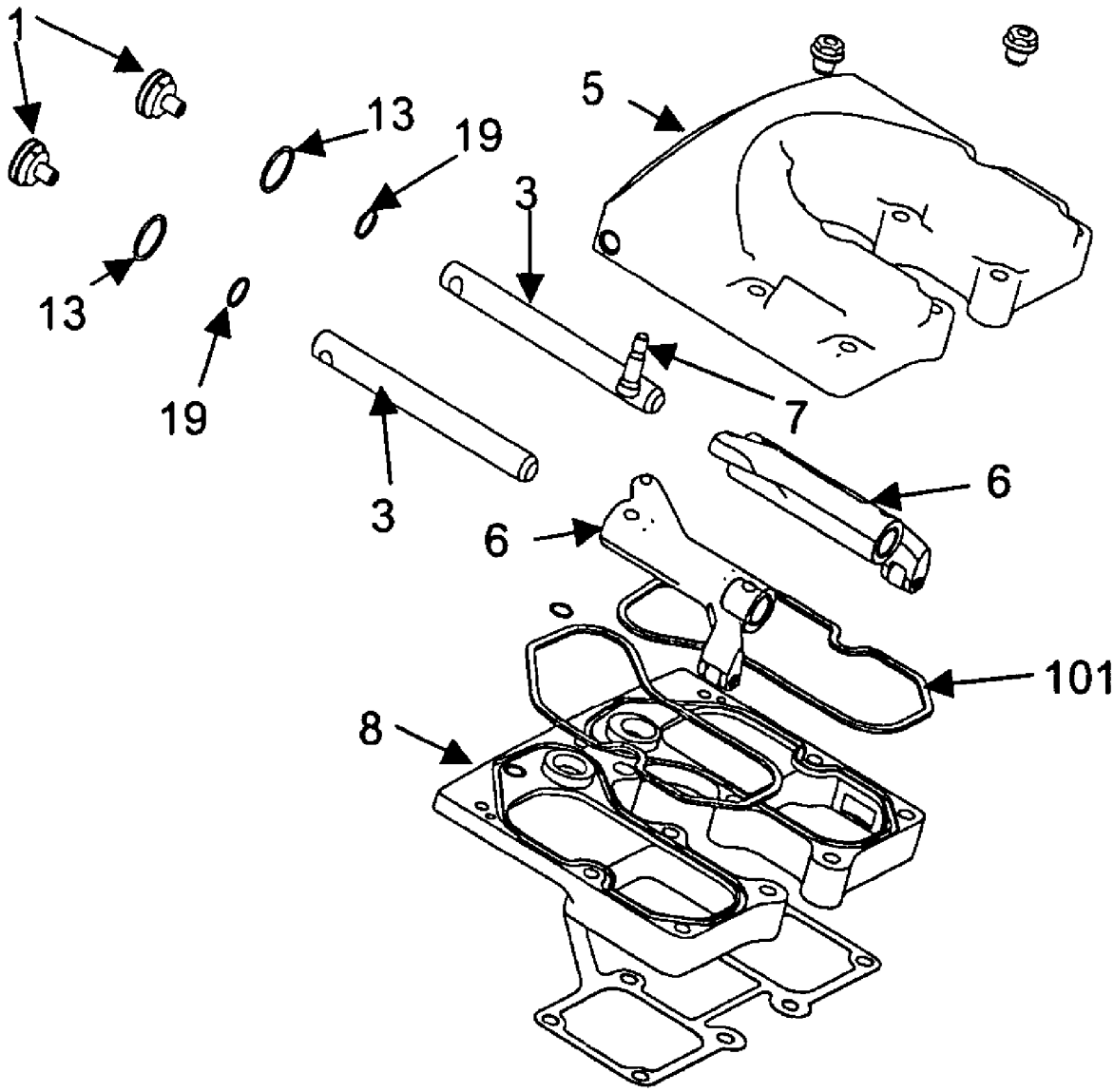
Figure 6:
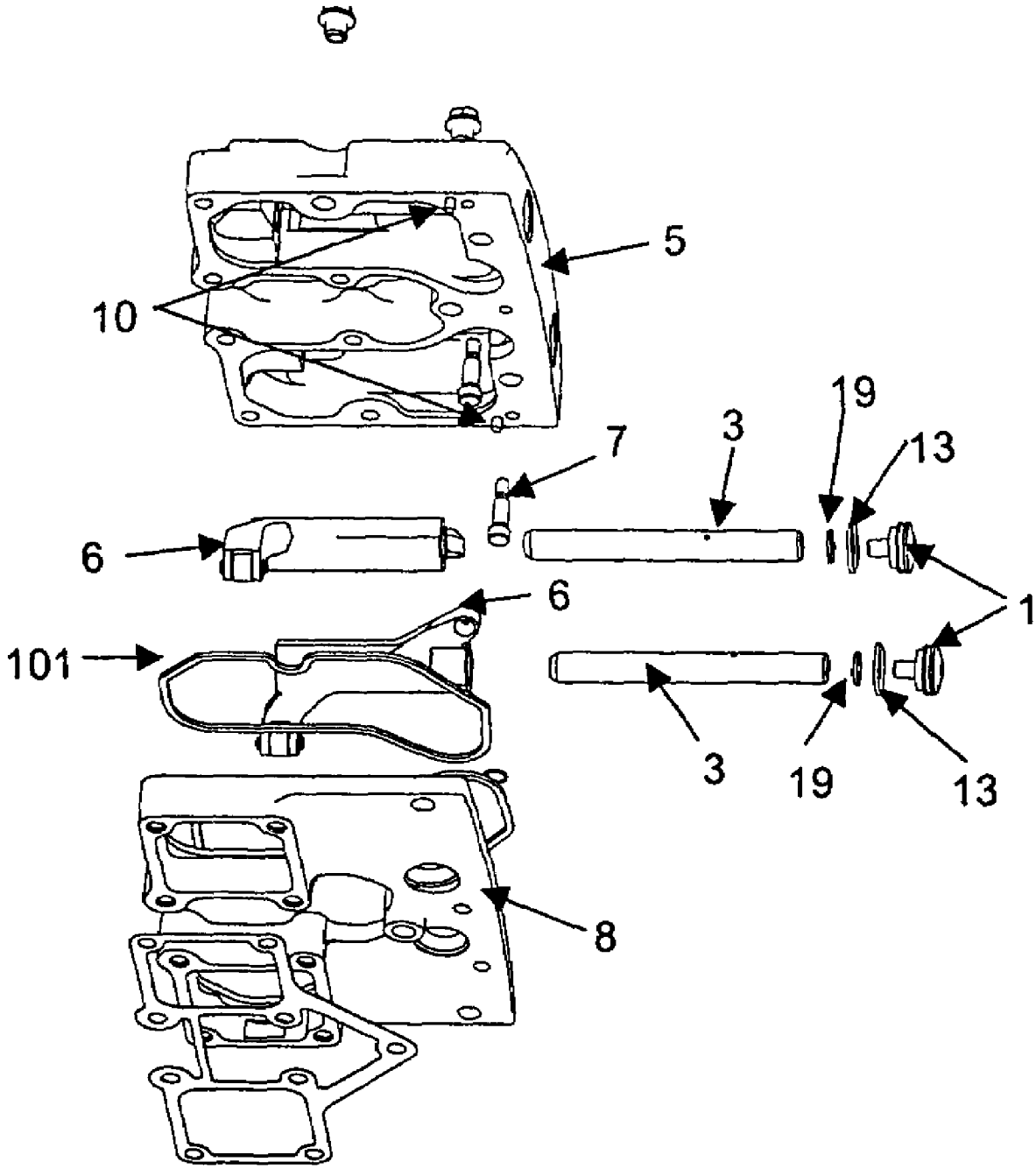
Figure 7:
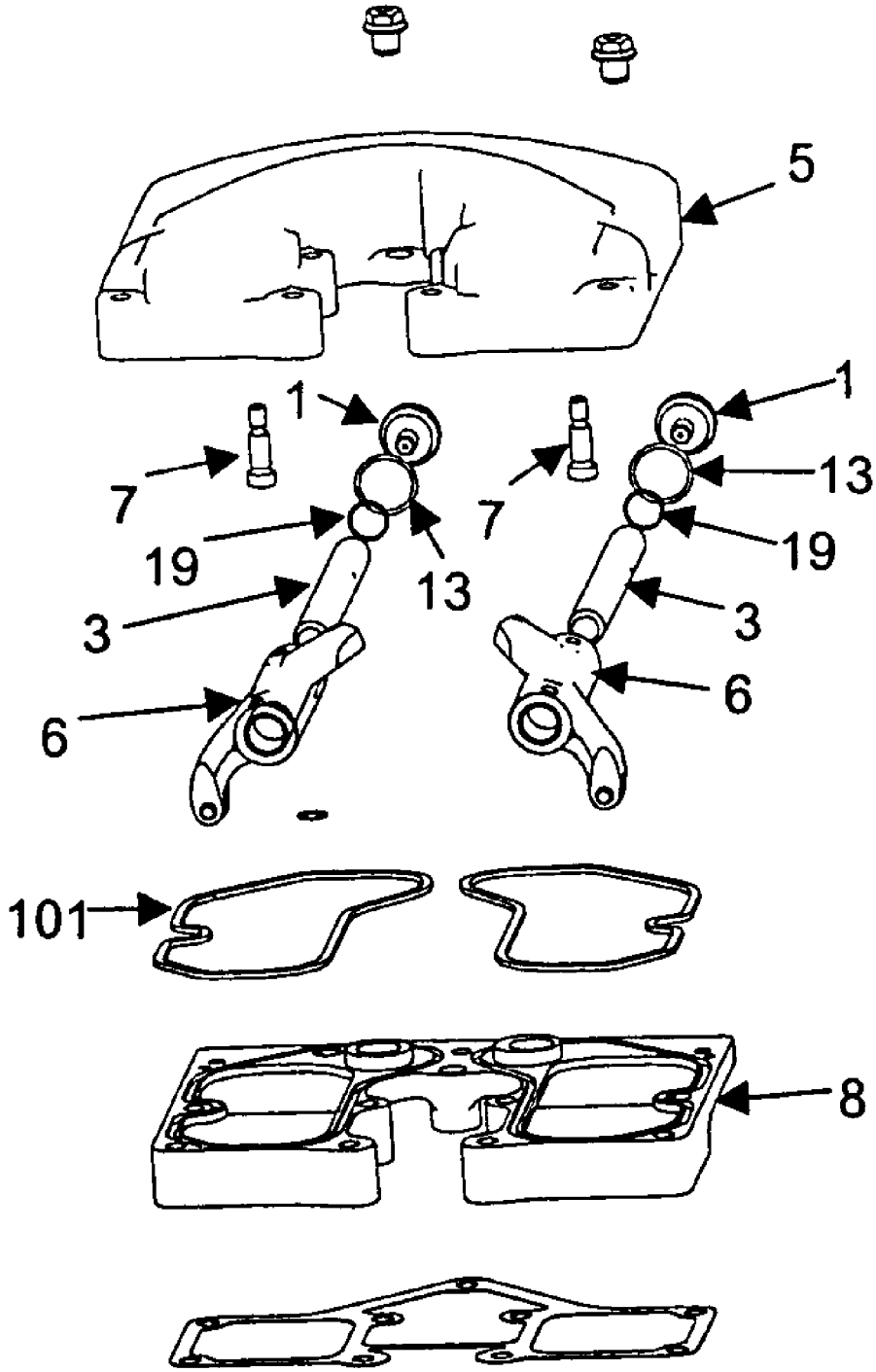
Figures 8, 8A, 8B:
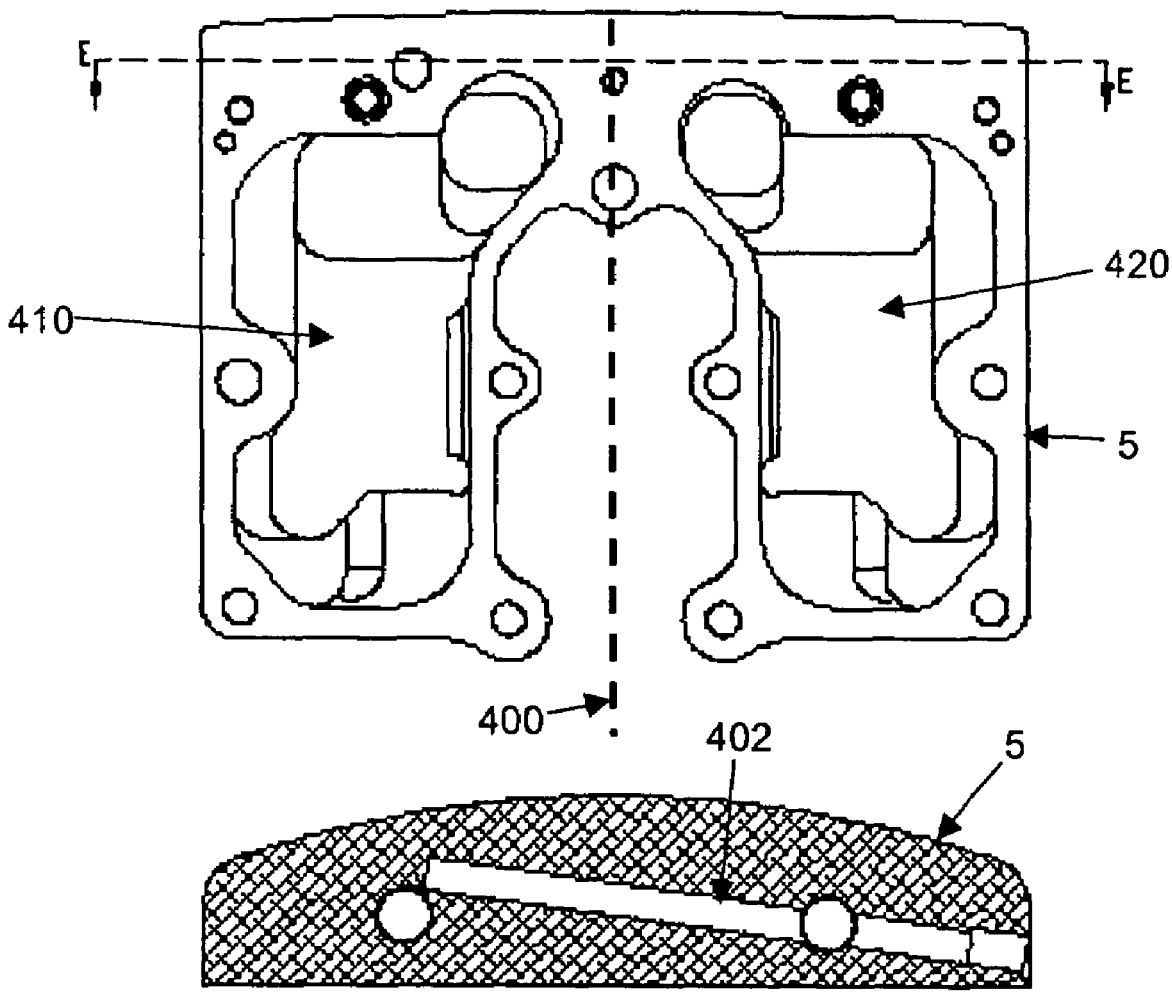
Figure 9:
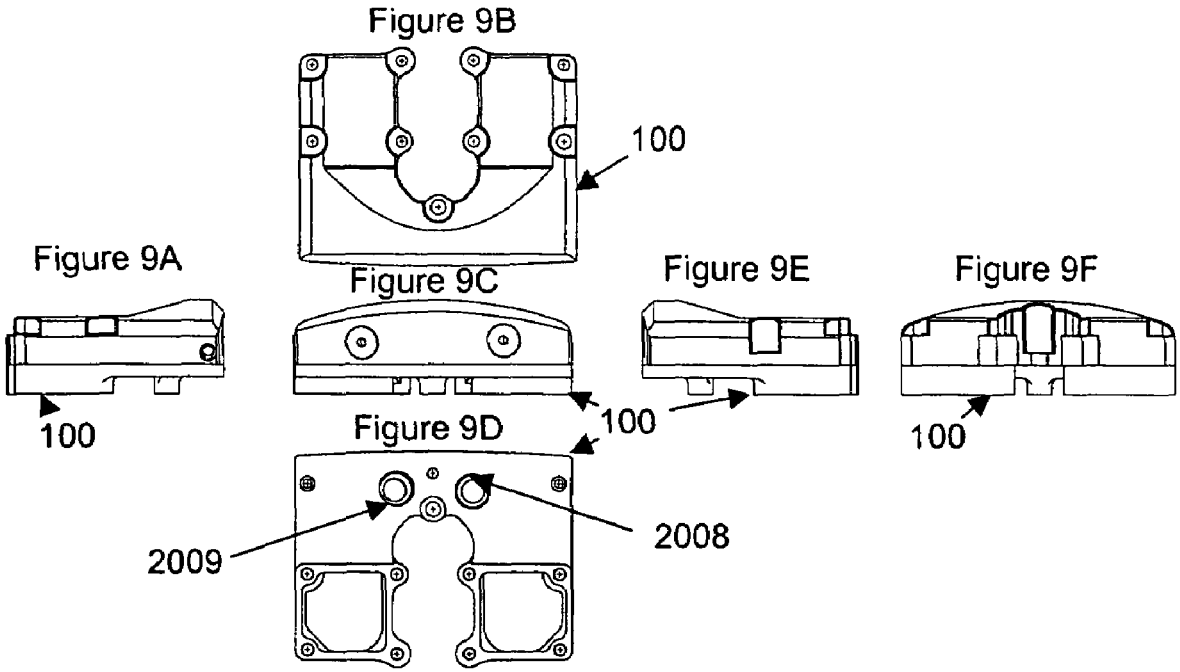
FIGS. 9A-9F depict views of an upper portion of the rocker box of FIG. 2 coupled to a lower portion thereof.
Figure 10:
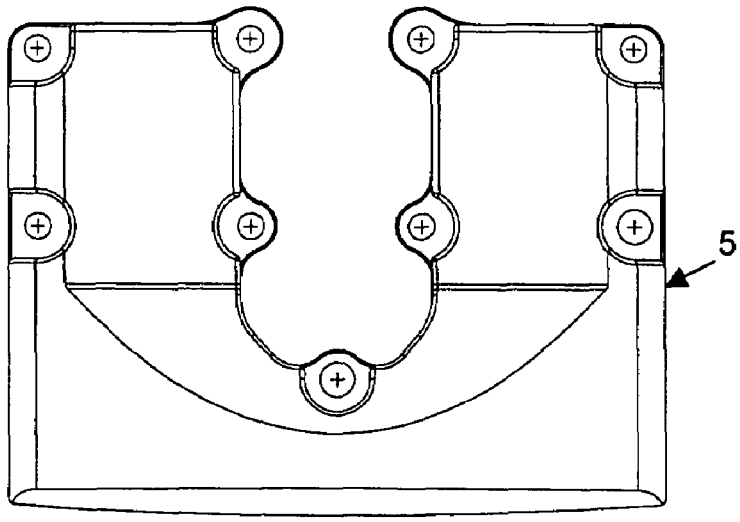
FIGS. 10-14 depict enlarged views of an upper portion of the rocker box of FIG. 2 coupled to a lower portion thereof.
Figure 11:
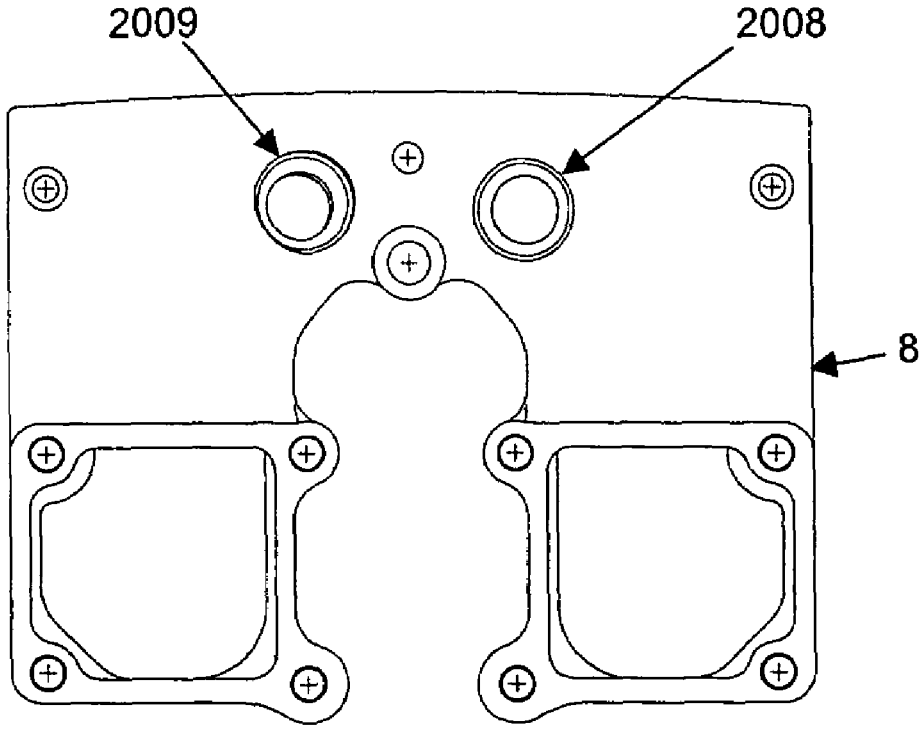
Figure 12:
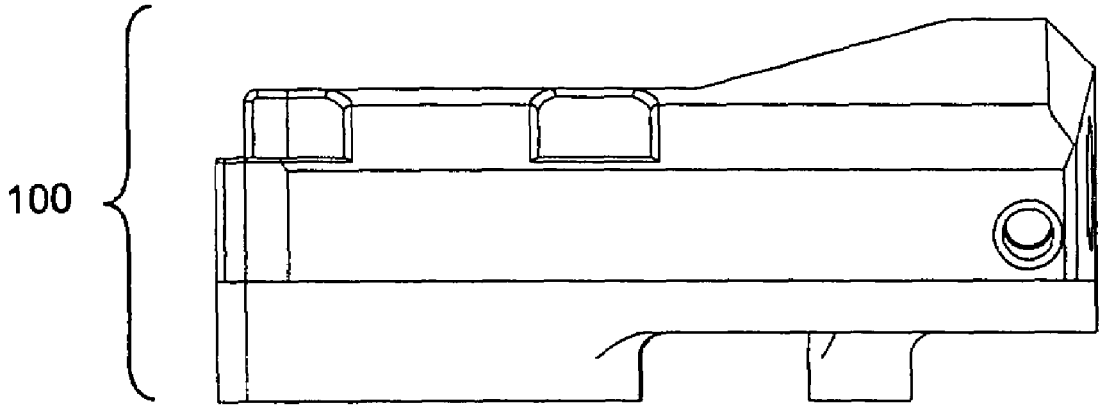
Figure 13:
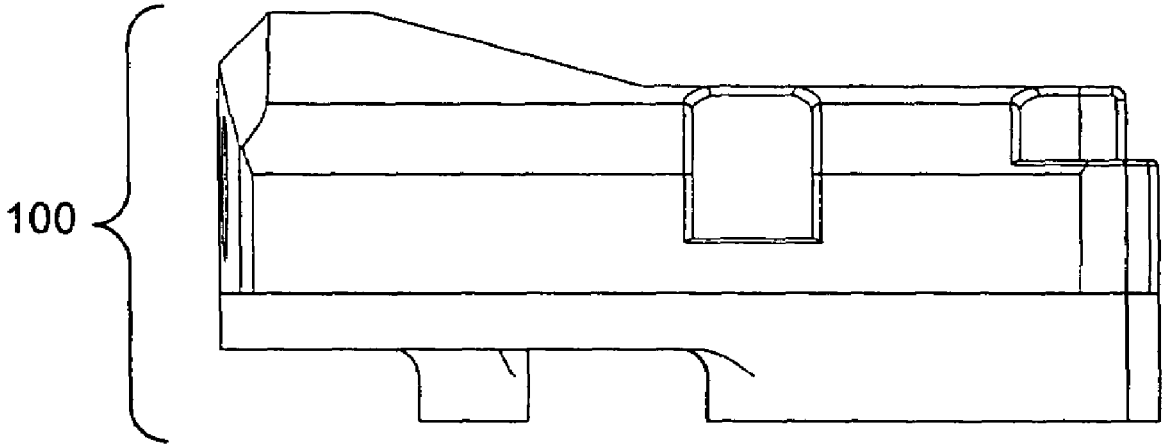
Figure 14:
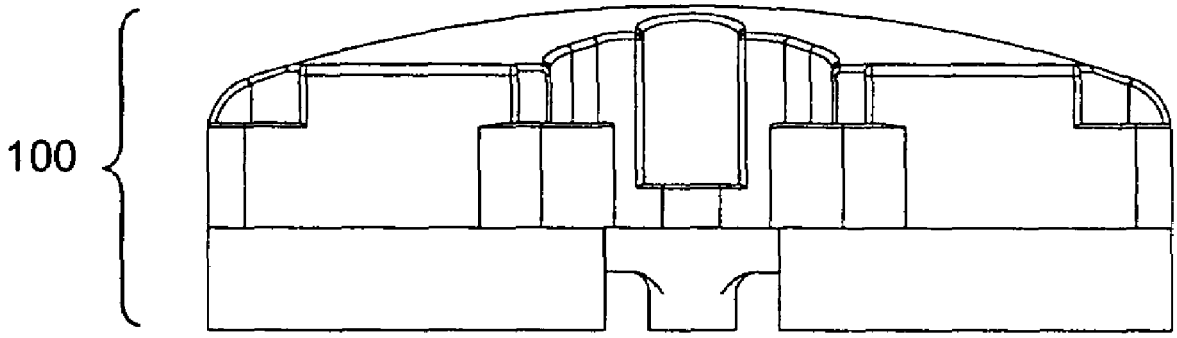

In order to provide an oil tight seal between the separable upper portion 5 and lower portion 8 when coupled together, a seal 101 (e.g., a gasket type/o-ring type seal) is used as shown best in FIG. 3. The seal 101 may be made of 70 Durometer Viton or like material, and installed in a groove formed within one or both of upper portion 5 and lower portion 8. Other configurations are also contemplated.

With the oil tight seal maintained using seal 101, oil is first distributed via a passage from the crankcase 120 to the upper portion 5 and/or lower portion 8 of the rear rocker assembly 100 (relative to a front of the engine), such as via an oil line or the like. Within one or both of the upper portion 5 and lower portion 8 of the rear rocker assembly 100, another oil passage 402 (FIG. 8B) is provided so as to channel oil between the two (or more) rocker arm assemblies positioned therein. Preferably, oil enters the rear rocker assembly 100, and is distributed via passage 402 to an exhaust rocker arm. At the exhaust rocker arm, oil enters via a hole 2003 in plug 1 (see FIG. 18), and then passes into rocker shaft oil passageway 2001. Oil may be delivered along a length of rocker shaft 3 using rocker shaft oil passageway 2001, such as to a rocker roller tip 1008 and ball socket 1004 via oil passageways 1002 and 1003 respectively (see FIGS. 17A-17D).

Oil then is passed from the exhaust rocker arm to the intake rocker arm (e.g., via passage 402 or another passage). Alternatively, oil may be passed to the intake rocker arm simultaneous with oil delivery to the exhaust rocker arm. Oil is delivered along a length of the intake rocker arm in a similar manner as previously described with respect to the exhaust rocker arm. A fitting on the upper portion 5/lower portion 8 of the rear rocker assembly 100 may be provided to facilitate an interconnection of an oil passage from the rear rocker box assembly 100 (e.g., the passage extending from the intake rocker) to the front rocker box assembly 100, where oil may be distributed in a like manner to the rocker arm assemblies positioned therein. Other oiling applications are also contemplated.

As previously noted, movable parts are positioned within the rocker box assemblies 100. Such movable parts may include, for example, rocker arm assemblies comprised of rocker arms 6, rocker shafts 3, plugs 1, and o-ring seals 13, 19. To facilitate positioning and housing of the rocker arm assemblies, one or both of the upper portion 5 and the lower portion 8 may include at least two cavities 410, 420 (FIG. 8A), which may be substantially opposite to each other about a central axis 400. Preferably, each cavity 410, 420 has a periphery adapted to receive a corresponding rocker arm 6 (not shown in FIG. 8A), without a separate rocker arm supporting structure. More preferably, each cavity 410, 420 includes a substantially straight portion for receiving a rocker shaft 3, and side portions for receiving pushrod assemblies 130 (FIG. 15) and for actuating valves (not shown). Additional cavities, holes, etc. may also be provided.

Figure 18:
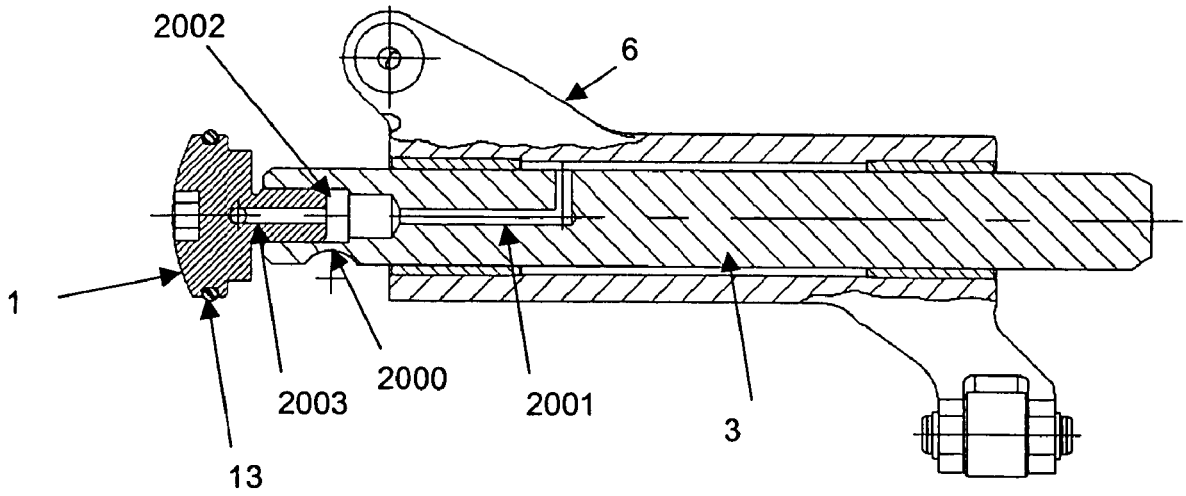
FIG. 18 depicts a sectional view of a rocker arm assembly including a rocker shaft positioned within a rocker arm according to an embodiment of the present invention.

As previously noted, according to one embodiment of the present invention a rocker arm assembly comprises a rocker arm 6 with rocker shaft 3 coupled thereto—see rocker arm counter bore 1007 and threaded rocker shaft counter bore 2002 with bushings 1005, 1006 in FIG. 17B and FIG. 18. The threaded rocker shaft counter bore 2002 preferably is threaded to receive a sealing/oiling plug 1. Installed in grooves o-rings 13, 19 are provided for sealing plug 1 and rocker shaft 3 in upper portion 5. Preferably, o-ring 13 is installed in a groove of plug 1, and o-ring 19 is installed in a groove of upper portion 5. O-ring 13 may be further received in a counter/main bore of upper portion 5/lower portion 8 for sealing oil delivery passages therein. As with seal 101, o-rings 13, 19 may be made of 70 Durometer Viton or like material.

Preferably, each rocker arm 6 receives a rocker shaft 3 with one or more notches 2000 for orienting the rocker shaft 3 against shoulder screws/bolts 7. In particular, these rocker shafts 3 may be pre-loaded against the shoulder screws/bolts 7 using plugs 1, thereby preventing unintentional movement of the shafts 3 and facilitating easy removal of the shafts 3 from the rocker arm assemblies and/or rocker box assemblies 100 (e.g., using about a ¼" Allen socket). Other mounting techniques are also contemplated, including dowel pins 10 which help locate the upper portion 5/lower portion 8 relative to one another.

According to one aspect of the present invention, the plug 1 is made of a heat treated (RC 33-37) 416 stainless steel, which can be readily polished and is corrosion resistant. Additionally, the rocker shafts 3 may be made of a different material, such as 8620 steel. Other materials are also contemplated.

Preferably, the shafts 3 are substantially straight as shown best in FIGS. 2-7, and comprise a single, integral piece. Using a straight shaft 3 which is separable from the rocker arm 6 can be a significant cost savings over other possible configurations, due to the elimination of complex rocker shaft assemblies and configurations and corresponding reduction in manufacturing costs. Further, the straight shaft 3 configuration reduces the number of holes required in the rocker box assembly 100 for positioning a rocker arm assembly therein, which, in turn, reduces the potential for oil leaks, and increases the strength of the rocker box assembly 100. Other advantages will also be observed through practice of the present invention.

Figure 16:
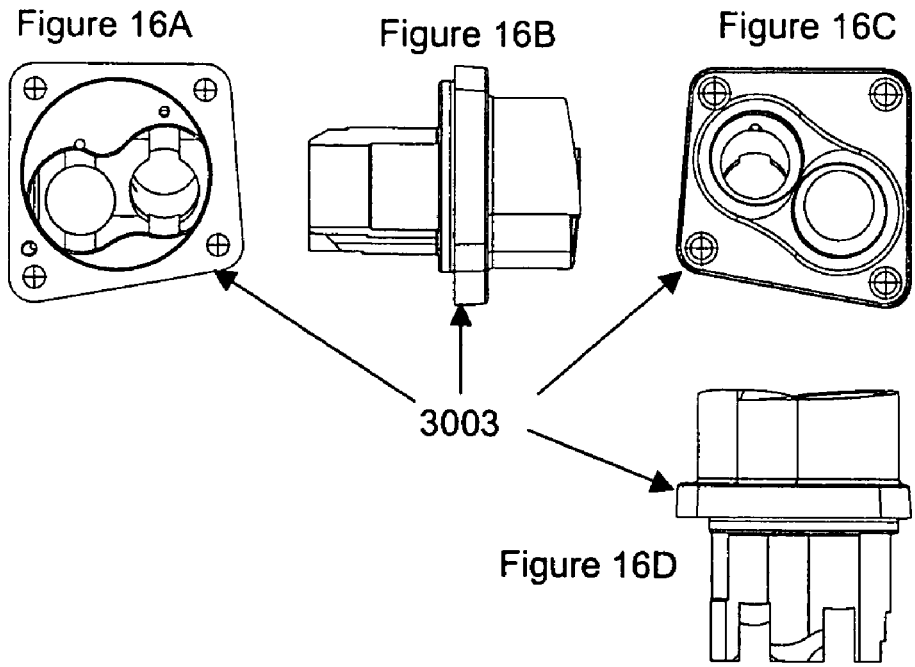
FIGS. 16A-H depict views of a tappet guide assembly according to an embodiment of the present invention.
Figure 16:
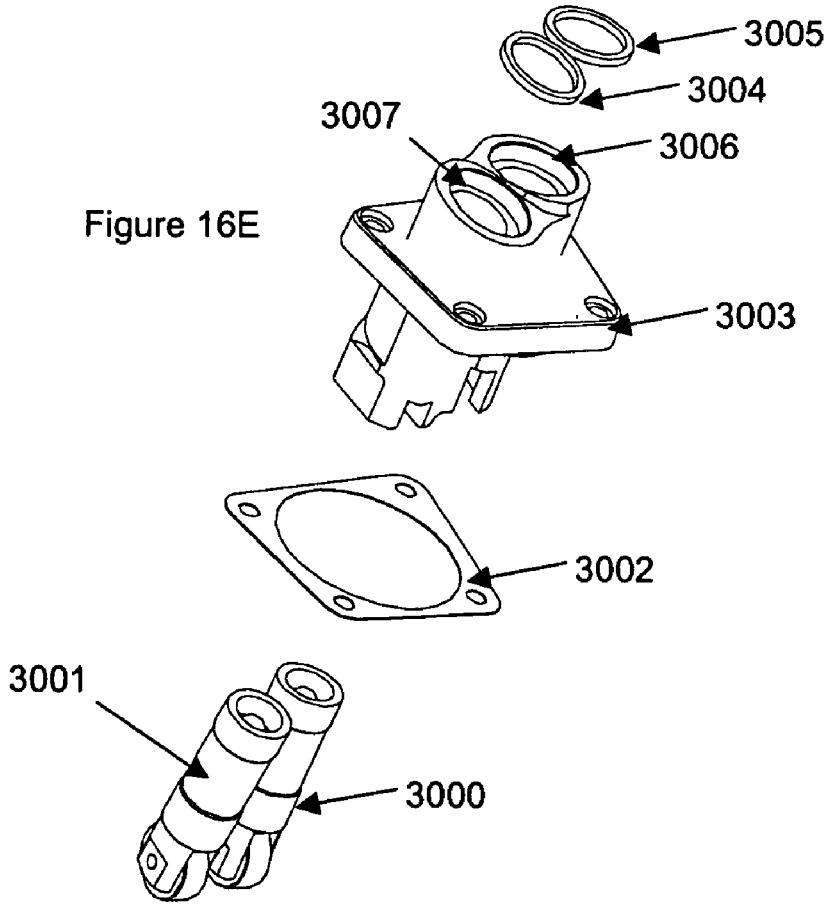
Figures 16F, 16G, 16H:
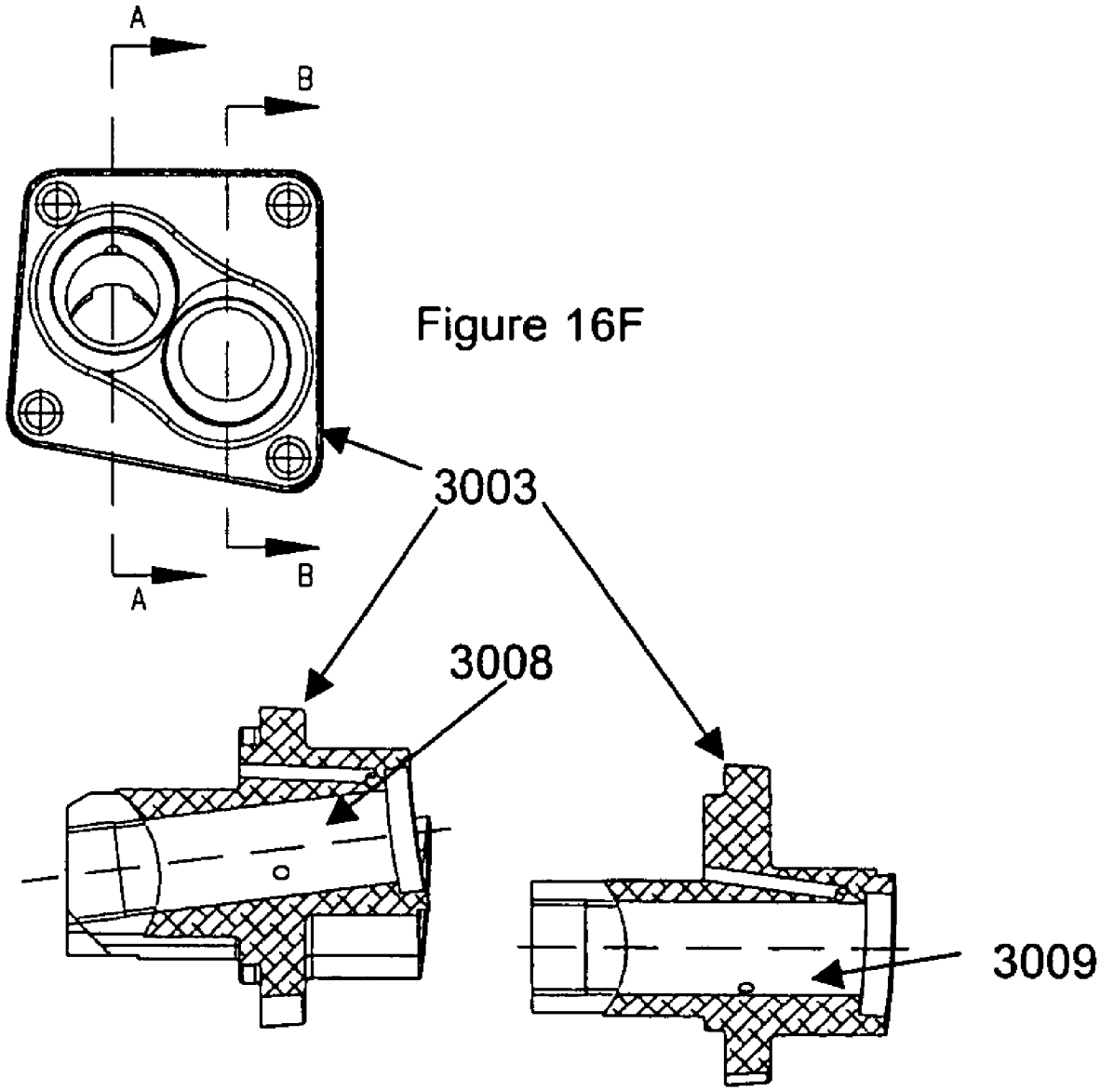
Figure 17D:
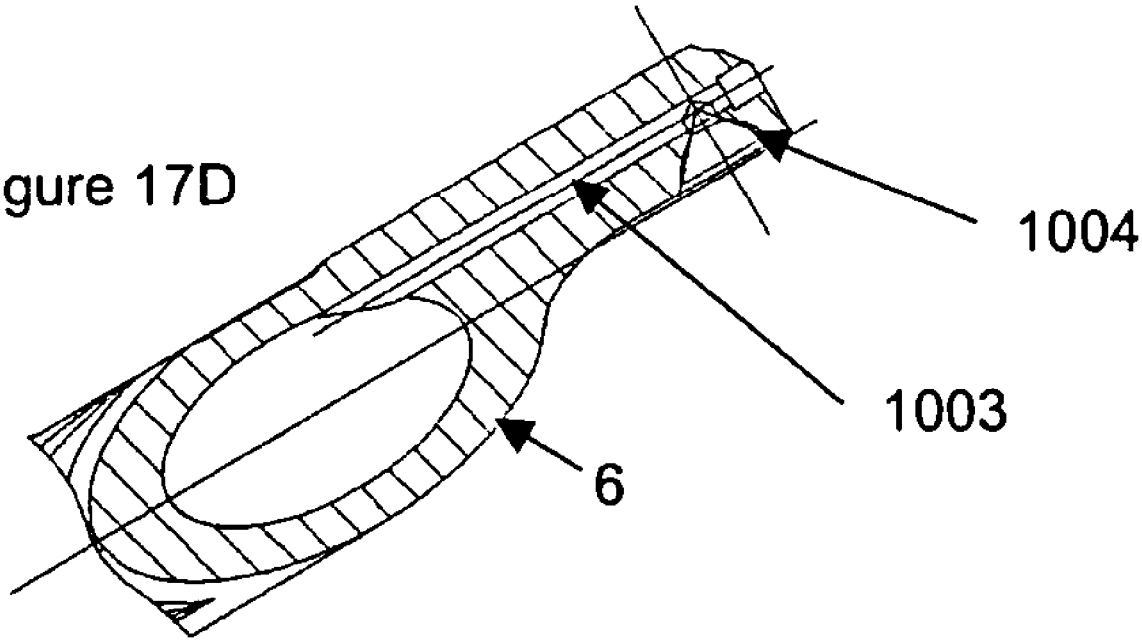

According to another embodiment of the present invention as shown best in FIGS. 15A and 15B, collapsible pushrod assemblies 130 are provided. The pushrod assemblies 130 are designed to project into the rocker box assemblies 100 for actuating the rocker arms 6, and are preferably received with ball sockets 2005, 2006 at each end. Each pair of pushrod assemblies 130 may be actuated by tappets 3000, 3001 (FIG. 16E) in the engine, the actuated pushrod assemblies 130 causing corresponding rocker arms 6 to rotate about a central axis thereof, thereby actuating a valve (exhaust or intake) via a roller tip 1008 or the like (FIG. 17B) on the rocker arm 6. In this regard, the rocker arms 6 are preferably machined and/or forged to maintain a ratio of about 1.5:1 or about 1.43:1 (as examples only) to actuate the valves at a precise ratio to the actuation of tappets 3000, 3001. According to one preferred embodiment of the present invention, Evolution style tappets are provided in the correct geometric orientation to actuate the pushrod assemblies 130 in a shovelhead style engine using Evolution style camshafts.

The pushrod assemblies 130 are preferably collapsible and adjustable, so as to facilitate easy removal and adjustment thereof. In particular, the pushrod assemblies 130 may each comprise a single threaded adjusting unit that threads into a pushrod shaft 530. In this regard the adjusting unit preferably includes a threaded portion 510 and an unthreaded portion 520, the unthreaded portion 520 being of smaller diameter than the threaded portion 510. When the single threaded adjusting unit is threaded all (or substantially all) the way into the pushrod shaft 530, the threads are disengaged and the unthreaded portion 520 of the adjusting unit can be slid inside the pushrod shaft 530, significantly reducing the overall length of the pushrod assembly 130. This reduced length allows for easy installation and removal of the pushrod assemblies 130 within the engine. As an example, pushrod assemblies 130 provided in engines equipped with Evolution style tappet guides and/or Evolution style cams can be installed/removed without removal of the upper portion 5 of the rocker box assembly 100 or the cylinder head assembly 110.

In an application where the oil is delivered via the pushrod assemblies 130, oil is supplied to the rocker arm 6 via an oil passageway 2007 (FIG. 15B) in the pushrod assembly 130. Such an oil delivery technique may be performed as an alternative or in addition to the oil delivery technique previously described in reference to oil passageway 402 in upper portion 5/lower portion 8. Other oil delivery techniques using pushrod assemblies 130 are also contemplated.

A tappet guide assembly according to another embodiment of the present invention is shown in FIGS. 16A-16H. In particular the tappet guide assembly includes a tappet block 3003 with pushrod cover counterbores 3006, 3007, each pushrod counterbore receiving a corresponding pushrod cover (with a pushrod assembly 130 positioned therein). Preferably, the pushrod counterbores 3006, 3007 are oriented so as to be substantially parallel to the counterbores in the rocker box assembly 100 in order to facilitate proper alignment of the pushrod assemblies 130.

One or more pushrod cover o-rings 3004, 3005 may be provided for sealing the tappet block 3003 to the pushrod covers, and one or more tappet gaskets 3002 may be provided for sealing the tappet block 3003 to a mounting surface. According to one aspect of the present invention as shown best in FIGS. 16G and 16H, one or more oil return passages may also be provided, the oil return passages including channels which pass down from the pushrod cover counterbores 3006, 3007 to below the gasket 3002 surface and breakout herefrom. Such passages may be formed, for example, by drilling two or more holes that intersect along a length thereof. A receiving counterbore may also be provided for receiving the oil from the noted channels, the receiving counterbore channeling the oil back down to a camchest in crankcase 120. In one exemplary configuration, the oil return passage(s) has a diameter of about 0.188", and couple to channels having a diameter of about 0.125" and a length of about 1.38". Other configurations are also contemplated.

The tappet block 3003 further includes one or more tappet bores 3008, 3009 for receiving tappets 3000, 3001. As would be understood by one of skill in the art, one or more camshafts actuate tappets 3000, 3001, which actuate pushrod assemblies 130, which actuate rocker arms 6 (via ball sockets), thereby opening and closing valves on the top of the engine. The tappet bores 3008, 3009 are thus positioned so as to properly align the tappets 3001, 3000 with the pushrod assemblies 130 (see FIGS. 16G and 16H). Hence, other configurations and orientations are also contemplated to compensate for variations in engine layout, such as to align pushrod cover counter bores for rocker arm assemblies in shovelhead or pushrod engines, and to maintain proper oil sealing.

The tappet block 3003 preferably has a shovelhead style configuration, but is adapted to use evolution style hydraulic tappets 3000, 3001 and evolution style camshafts. As such, the tappet block 3003 is preferably slightly larger than conventional shovelhead style tappet blocks. By way of example, stock tappet bores are typically ø 0.73215 whereas the enlarged tappet block 3003 of the present invention is greater than ø 0.73215, such as about ø 0.84335 (i.e., about 15% larger). Other exemplary sizes may include, for example, at least 5% larger, at least 10% larger, etc. in comparison to stock parts (e.g., Harley Davidson part no. 18522-53A). In addition to providing greater functionality, the enlarged size further has better wear characteristics than conventional devices.

Preferably, the tappet guide assembly is machined from a billet aluminum base material, which provides high dimensional accuracy and a consistent polishing and chrome plating. Alternatively, one or more of the tappet guide assembly parts may be cast from aluminum, steel or a like material.

The foregoing description of various embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

PARTS LIST cavities 410, 420
central axis 400
crankcase 120
cylinder head assembly 110
dowel pins 10
gasket seal 101
lower portion 8 (of rocker box)
lower pushrod ball socket 2005
oil passageway 2003 in plug
oil passageway 1002 in rocker arm to roller tip
oil passageway 1003 in rocker arm to ball socket
oil passageway 2007 in pushrod
oil passage 402
o-ring seal 13
o-ring seal 19
plug 1
pushrod assembly 130
pushrod cover o-ring 3004, 3005
pushrod cover counterbore 3006, 3007
pushrod cover counterbores-rocker cover 2008
pushrod cover counterbores-rocker cover 2009
pushrod shaft 530
rocker arm 6
rocker arm ball socket 1004
rocker arm bushings 1005, 1006
rocker arm counter bore 1007
rocker box assembly 100
rocker shaft 3
rocker shaft oil passageway 2001
rocker shaft orienting notches 2000
rocker shaft threaded counter bore 2002
roller tip 1008
shoulder screw/bolt 7
tappet 3000, 3001
tappet block 3003
tappet block gasket 3002
tappet bore 3008, 3009
threaded portion of adjusting unit 510
unthreaded portion of adjusting unit 520
upper portion 5 (of rocker box)
upper pushrod ball socket 2006

What is claimed is:

1. An oil delivery system for delivering oil to rocker arms in a motorcycle engine, comprising:

a first oil line for supplying oil to a first rocker box;

a first oil passageway formed within a wall of the first rocker box for distributing oil from the first oil line to rocker shafts on which at least two rocker arms are operably supported within the first rocker box; and wherein each rocker arm includes a second oil passageway extending along an associated one of the rocker shafts for distributing oil from the first oil passageway along a length of each rocker arm.

2. The oil delivery system of claim 1, further comprising a third oil passageway formed within a first pushrod assembly for distributing oil to one of the at least two rocker arms positioned within the first rocker box.

3. The oil delivery system of claim 1, further comprising a second oil line for supplying oil from the first rocker box to a second rocker box.

4. The oil delivery system of claim 1, wherein oil enters each rocker arm via plugs coupled to ends of the at least two rocker shafts.

5. A motorcycle engine including the oil delivery system of claim 1.

6. A motorcycle including the motorcycle engine of claim 5.

7. The oil delivery system of claim 1, further comprising a third oil passageway formed within the rocker arm for distributing oil from the second oil passageway to a ball socket portion of the rocker arm.

8. The oil delivery system of claim 7, further comprising a fourth oil passageway formed within the rocker arm for distributing oil from the second oil passageway to a rocker roller tip portion of the rocker arm.

9. The oil delivery system of claim 1, further comprising a third oil passageway formed within the rocker arm for distributing oil from the second oil passageway to a rocker roller tip portion of the rocker arm.

10. A motorcycle engine comprising:

a crankcase with at least one cylinder:

a cylinder head assembly mounted on the crankcase:

a rocker box mounted on the cylinder head, the rocker box including at least two rocker arms and a rocker shaft supporting each of the at least two rocker arms; and means for delivering oil to a tip of each of the at least two rocker arms, including a first oil passageway extending longitudinally along the rocker shaft and a second oil passageway connected to the first oil passageway and extending therefrom to the tip of the each rocker arm, the second oil passageway being formed within a section of material in each rocker arm that extends to and forms part of the tip.

11. The motorcycle engine of claim 10, further comprising means for supporting the at least two rocker arms within the rocker box.

12. The motorcycle engine of claim 11, further comprising means for actuating the at least two rocker arms.

13. A motorcycle engine including the oil delivery system of claim 10.

14. A motorcycle including the motorcycle engine of claim 13.

15. The motcrcycle engine, comprising:

a crankcase with at least one cylinder:

a cylinder head assembly mounted on the crankcase:

a rocker box mounted on the cylinder head, the rocker box including upper and lower portions sealingly attached together using at least one seal, and including at least two rocker arms; and means for supporting the at least two rocker arms within the rocker box, the means including a rocker shaft for supporting the at least two rocker arms;

the rocker box, the rocker shaft, and each rocker arm each having material defining portions of a continuous oil passageway from an outer surface of the rocker box to a location near a tip of the rocker arms.

16. The motorcycle engine of claim 15, further comprising means for actuating the at least two rocker arms.

17. A method of delivering oil to rocker arms in a motorcycle engine, comprising:

supplying oil to a first rocker box;

distributing oil to at least two rocker arms positioned within the first rocker box; including distributing oil along a rocker shaft of each rocker arm, and including distributing oil through an oil passageway in each rocker arm directly to location near a tip of each rocker arm, the oil passageway being defined by a section of material of each rocker arm that extends from the rocker shaft to the respective tip.

18. The method of claim 17, wherein supplying oil to a first rocker box comprises supplying oil via a first oil line external to the motorcycle engine.

19. The method of claim 17, wherein supplying oil to a first rocker box comprises supplying oil via an oil passageway in a pushrod assembly.

20. The method of claim 17, further comprising distributing oil to at least one of a rocker roller tip portion of each rocker arm and a ball socket portion of each rocker arm.

* * * * *